United States Patent [19]

Curatolo

[11] 4,090,335

[45] May 23, 1978

[54] PARTITION PANEL FOR SUBDIVIDING A ROOM AREA

[76] Inventor: Frank Curatolo, 130 Overlook Ave., Hackensack, N.J. 08602

[21] Appl. No.: 833,303

[22] Filed: Sep. 14, 1977

[51] Int. Cl.[2] ..... E04B 1/38

[52] U.S. Cl. ..... 52/239; 52/285; 24/204; 52/DIG. 13

[58] Field of Search ..... 52/284, 239, 285, DIG. 4, 52/238; 46/DIG. 1, 21, 19, 17, 31; 160/135, 229; 24/204

[56] References Cited

U.S. PATENT DOCUMENTS

| | | | |
|---|---|---|---|
| 3,475,810 | 11/1969 | Mates | 24/204 |
| 3,571,999 | 3/1971 | Downing | 46/31 |
| 3,721,050 | 3/1973 | Perina | 24/204 |
| 3,777,435 | 12/1973 | Perina | 52/DIG. 13 |
| 3,807,112 | 4/1974 | Perina | 52/DIG. 13 |
| 4,028,855 | 6/1977 | Prewer | 52/DIG. 13 |
| 4,029,316 | 6/1977 | Clarke | 46/DIG. 1 |

FOREIGN PATENT DOCUMENTS

| | | | |
|---|---|---|---|
| 1,300,206 | 6/1962 | France | 52/DIG. 13 |
| 7,300,610 | 1/1973 | Sweden | 160/135 |

*Primary Examiner*—John E. Murtagh
*Attorney, Agent, or Firm*—Bauer, Amer & King

[57] ABSTRACT

A partition panel intended for combination with similarly constructed panels in subdividing a room area that obviates prior art difficulties in using cooperating Velcro-identified fasteners. The fastener strip on the panel vulnerable to being inadvertently pulled free thereof upon disengagement of the panels is effectively held thereon by being wrapped about the periphery of the panel; the forces thus are resisted by the longer length of the strip rather than being localized in the smaller portion thereof being separated from the cooperating fastener.

4 Claims, 6 Drawing Figures

PRIOR
ART

PARTITION PANEL FOR SUBDIVIDING A ROOM AREA

The present invention relates generally to a room divider or so-called partition panel, and more particularly to an improved lightweight, easily installed panel of the nature noted. In the installation or use thereof, the panel hereof is adapted to be attached to panels of similar construction to form barriers, as by being attached end-to-end, or to form T-shapes or otherwise subdivide the room area, for interior decorating or other utilitarian purposes.

Separable hook and/or loop type fasteners, as sold under the trademark VELCRO and as described in U.S. Pat. Nos. 2,717,437 and 3,009,235, have a recognized potential advantageous use for installing partition panels. See, for example, U.S. Pat. No. 3,807,112. This noted end use, however, has not been fully achieved because of the difficulty of preventing one or both of the cooperating fasteners from being inadvertently torn free of its support surface when the panels are separated. To obviate this difficulty, use must be made of a complex technique of firmly adhering the fastener to the panel or, as disclosed in the above noted U.S. Pat. No. 3,807,112, the panels are not attachable to each other, but to supporting frame structure on which there is no detriment in firmly mounting the fastener.

Broadly, it is an object of the present invention to provide an improved partition panel overcoming the foregoing and other shortcomings of the prior art. Specifically, the partition panel hereof is attachable to panels of similar construction using Velcro-identified fasteners, and said fasteners are firmly mounted thereon without requiring a complex mounting structure that would unduly add to the cost of the panel, adversely affect its appearance, or otherwise result in a disadvantage.

An improved partition panel for combination with similarly constructed partition panels in subdividing the area of a room demonstrating objects and advantages of the present invention is one which, in a preferred construction, includes an internal plastic body having plural openings therein for reducing the weight thereof. A rectangular frame having an appropriately sized rectangular opening therein receives said plastic body to form a composite body structure. Next, a pair of flat sheets are applied as facing on opposite sides of the composite body structure to essentially complete the construction of said partition panel, except for the fasteners. One of the fasteners is applied as a pair of fabric covers, each of a looped fibrous construction, by being adhesively secured in covering relation on opposite sides of the partition panel. The other fastener, a fabric strip of an extending hook-like fibrous construction adapted to engage with said looped fibrous construction of said fabric covers, is adhesively secured about the periphery of the partition panel, such that the user can achieve engagement of two panels incident to the contact of the fabric strip of one panel to the fabric cover of a cooperating panel. In accordance with the present invention, the fabric strip is of a lengthwise size to extend along both vertically oriented edges of a panel and at least along one horizontally oriented edge thereof, whereby during disengagement of said two partition panels at the juncture of a vertically oriented edge of one from its contact with a fabric cover of the other, the length portion of the fabric strip being disengaged is prevented from inadvertent removal from about said partition panel by the wrapped positioning of the remaining length portion thereof.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a partial perspective view illustrating an exemplary technique now in use for vertically supporting a room divider or partition panel using cooperating fasteners in the specific form of Velcro-identified strips or the like;

FIGS. 2A–5 illustrate an improved manner of utilizing cooperating Velcro-identified fasteners in the construction of a partition panel to facilitate the combining of panels similarly constructed in the subdividing of an area of a room. More particularly, FIG. 2A is a perspective view illustrating how two such improved partition panels hereof cooperate to provide a subdivided room area for a desk or similar piece of furniture; FIG. 2B shows two panels connected end-to-end, to serve as a privacy barrier or the like;

Figure 1:
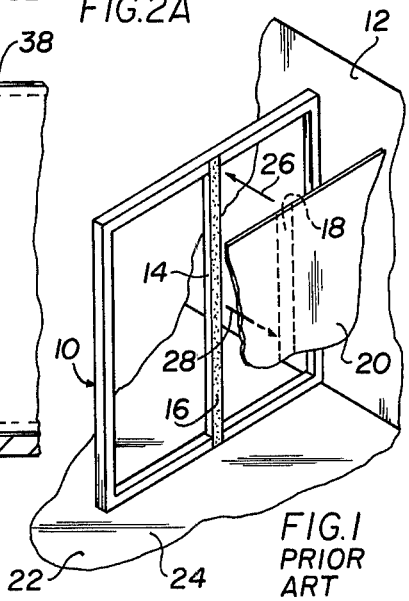

In common use are separable hook and/or loop type fastener means such as are described in U.S. Pat. Nos. 2,717,437 and 3,009,235 sold under the trademark VELCRO. The end uses of Velcro-identified fastener means are extremely numerous and include being embodied in the construction of room dividers or panels to facilitate maintaining an erect or upstanding position in the panel during its functioning as a room or space divider. The just referred to end use of the fastener means in connection with a partition panel is exemplified by the room structure and panel assembly described in U.S. Pat. No. 3,807,112, and is also exemplified by the prior art illustration of FIG. 1 hereof. More particularly, FIG. 1 depicts a typical situation in which a wooden frame 10 is appropriately mounted in an erect position in relation to a wall 12 and has adhesively or otherwise appropriately secured to a frame member 14 a strip 16 of extending hook-like projections, which strip is one of the fastening means heretofore referred to as being sold under the trademark VELCRO. The material which cooperates with strip 16 is designated 18 and is also advantageously in strip form and consists, as is well understood, of a closed loop fibrous construction which is adapted to engage with the hook-type extensions of strip 16. Fastening strip 18 is adhesively or otherwise appropriately secured to one of the surfaces of the partition panel 20 which is then readily supported on the vertical frame 10 when the strips 18 and 16 are brought into contact with each other. When in position, panel 20 of course physically separates or subdivides the floor spaces or areas 22 and 24 from each other, and thus enhances interior decorating of the spaces or their utility in some other way.

While the prior art use of the fastening strips 16 and 18 in connection with partition panels 20 as just described in connection with FIG. 1 has obvious merit since the mounting of panel 20 is achieved simply by movement 26 of panel 20 into contact with the frame 10, said FIG. 1 arrangement also has obvious shortcomings. One shortcoming resides in the fact that disengaging or reverse direction movement 28 of the panel 20 from the frame 10, as would be required for example in relocating the panel 20, subjects the fastening strips 16 and 18 to significant forces which tend to pull the strips from their respective support surfaces. That is, the interconnection of the loops of strip 18 on the hook-like extensions of strip 16 naturally resists separating movement 28 of the panel 20 from the frame 10, and this resistance tends to either pull the strip 16 from the frame member 14 or the strip 18 from the panel 20. Thus, prior art utilization of the strips 16 and 18 in the mounting of partition panels 20 requires advanced techniques of mounting and holding the strips 16 and 18 onto their respective support structures, a requirement that is not easily satisfied and thus undoubtedly accounts for the unavailability of a truly effective prior art panel 20 advantageously using the fastening strips 16 and 18.

Figure 2B:
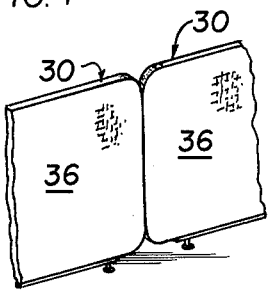
Figure 2A:
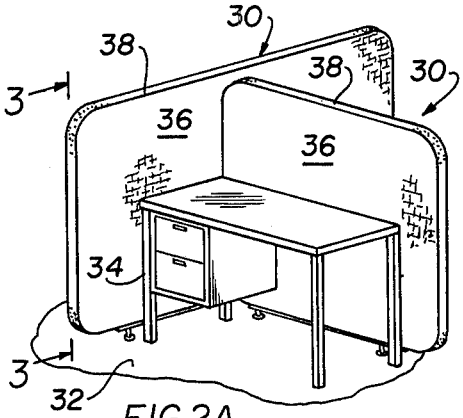
Figure 3:
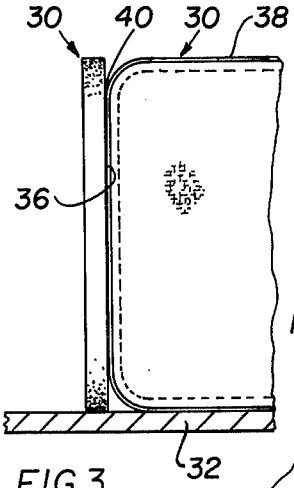
FIG. 3 is a side elevational view projected from FIG. 2A and as viewed from the vantage point depicted by the arrows 3—3 of FIG. 2A, said view illustrating the line contact established by one panel against the other which results in their being mutually held in their standing or vertical orientations illustrated.

In contrast to prior art practice and techniques as exemplified in FIG. 1, the present invention, as shown in FIGS. 2A–5 is directed to an improved construction for a partition panel, generally designated 30, which is readily combinable with panels similarly constructed, as illustrated more particularly in FIG. 2A, in the subdividing of a floor area 32 for interior decorating or utility purposes, i.e. to provide a nook or other isolated area for a desk 34 or the like. The individual structural features of the construction of panel 30 will of course be set forth in more detail subsequently, but it will be noted at this point in the description that structurewise each panel 30 includes a fabric covering, designated 36, which will be understood to have a looped fibrous construction similar to that already described in connection with the Velcro-identified fasteners 16, 18. Cooperating with the fastening member in the form of a fabric covering or cover 36 is a strip 38, said strip being of an extending hook-like fibrous construction adapted to engage with the looped fibrous construction of the panel fabric covering 36. The referred to strip 38 is disposed about the vertical edges of each panel 30 and a length portion, possibly without hooks extending therefrom, at least along the top horizontally oriented edge thereof. As a result, and as best shown in FIG. 3, line contact, as at 40, can be established between a vertically oriented length portion of strip 38 of one panel 30 with the fabric covering 36 of cooperating panel 30 such that at said contact area 40, the fastening means 36 and 38 engage with each other to the end of maintaining the two panels 30 in their operative space-dividing positions as depicted in FIGS. 2A, 3. More important, however, when panel 30 containing the strip 38 is used in forming the connection at the confronting surfaces 40 is disengaged from its cooperating panel 30, the disengaging or separating movement is readily prevented from pulling strip 38 free of its attachment or connection to the panel 30. Similarly, fabric cover 36 is readily maintained in its position on panel 30.

Figure 4:
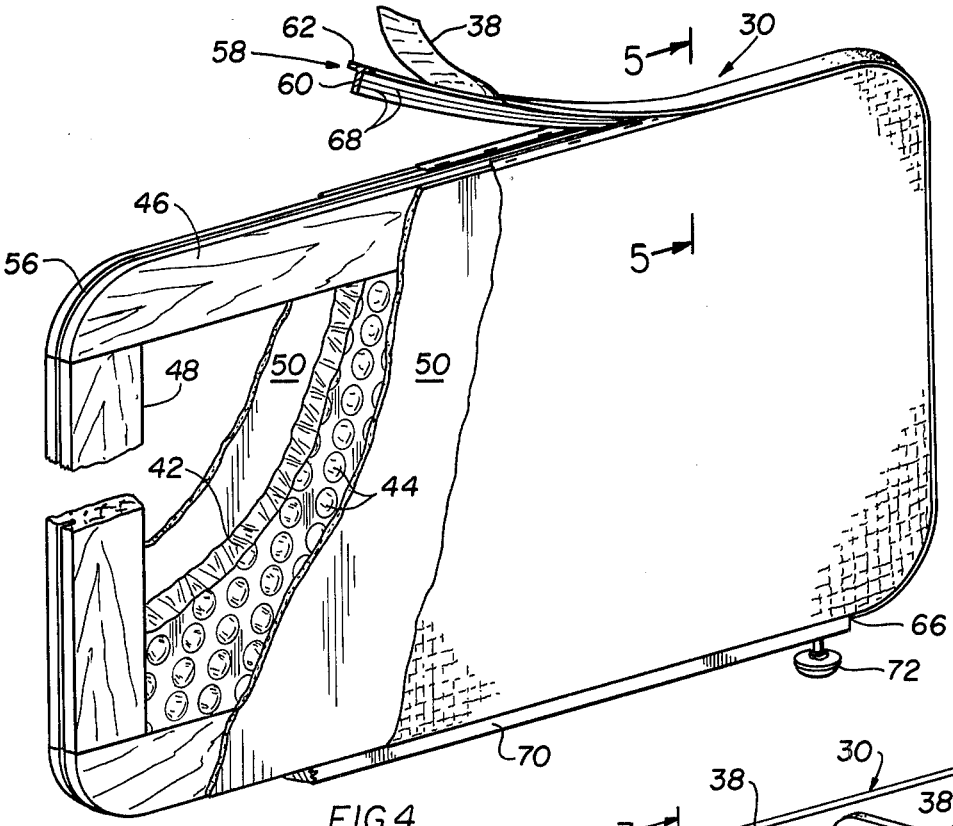
FIG. 4 is an enlarged scale perspective view of an improved panel hereof with portions broken away to illustrate details of the construction thereof.

A preferred construction for the panel 30 which effectively maintains the fastening means 36 and 38 in their respective positions on the panel 30, as well as providing the panel with rigidity together with an optimum minimum weight which enables it to be readily transported about, as well as other advantageous features, is illustrated more particularly in FIGS. 4 and 5 and will now be described in detail. Said construction includes an internal plastic body 42 having plural openings therein, individually and collectively designated 44, which openings significantly reduce the weight of the plastic body 42. A rectangular frame 46, preferably wooden, has an opening 48 appropriately sized to receive the plastic body or panel 42 and cooperates in receiving same to form a composite body structure. The four members which cooperate to provide the rectangular frame 46 are provided with a centrally located groove 56 which extends entirely about the panel 30, the significance of which groove 56 will soon be readily apparent.

A pair of flat sheets 50, preferably of hardboard or other such material, are applied as facing on opposite sides of the composite body structure 42, 46 to complete the construction of each panel, except for the fasteners of the Velcro-identified type previously noted as components 36 and 38.

Figure 5:
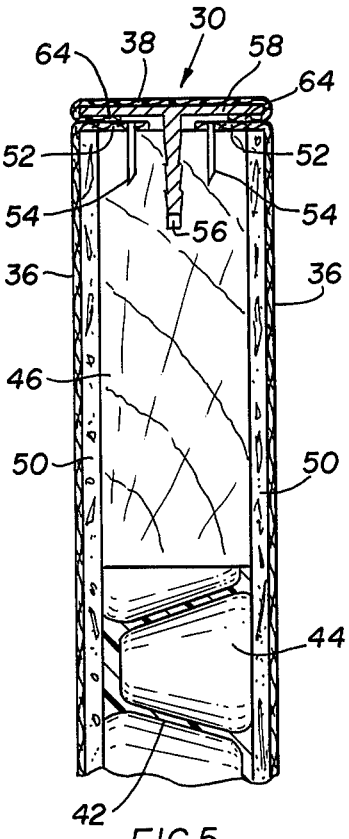
FIG. 5 is a partial side elevational view in section taken along lines 5—5 of FIG. 4 illustrating further structural details of the panel.

As perhaps best illustrated in the sectional view of FIG. 5, each fabric cover 36 is adhesively secured to a flat sheet 50 in covering relation on opposite sides of each panel, and an upper marginal edge of each cover 36, designated 52, is folded over on top of frame 46 and secured in place by spaced apart staples 54.

To mount the connecting strip 38 use is made of a T-shaped molding 58 having a vertically oriented leg 60 and horizontally oriented leg 62. Strip 38 is of a selected width that is slightly greater than leg 62 so that the strip can be placed in supported position on top of leg 62 and the peripheral portions thereof, designated 64 in FIG. 5, folded under the horizontal leg of molding 58. An adhesive at the interface of the strip 38 with the molding 58 may be advantageously used to maintain the just described position of strip 38 on the molding 58.

What is relied on, in accordance with the present invention, in maintaining strip 38 on the panel 30 is the fact that said strip and its support 58 extend in a wrapped relation about the panel frame 46. That is, strip 38 in its supported position on molding 58 starts adjacent one of the bottom corners of panel 30, as at location 66, and extends therefrom along one vertical edge of the panel, along the upper horizontal edge thereof, and then down along the opposite vertical edge of the panel terminating just beyond the opposite lower corner of panel 30, i.e. a location corresponding to previously referred to location 66. As a result of the partial wrap of strip and molding 38, 58 about the periphery of panel 30, the forces involved in disengaging the vertically oriented length portion of strip 38 are resisted not only by this specific vertically oriented length portion, but also by the horizontally oriented length portion. This extent of resistance has been found to be effective in preventing inadvertent disengagement of the strip 38 from about the periphery of the panel 30.

To actually mount strip 30 and molding 58 about the periphery of panel 30 the vertical leg 60 of molding 58 is projected in a friction fit in the groove 56, said leg 60 having lateral projections or gripping shoulders 68 appropriately machined therealong to prevent inadvertent disengagement of molding 58 from about the periphery of panel 30.

A preferred embodiment of panel 30 is completed by the attachment of an elongated aluminum base member 70 that is appropriately attached, as by screws or bolts, to the underside of panel 30 and has threadably engaged therewith threadably adjustable depending feet members 72.

As clearly illustrated in FIG. 2B, the improved panels 30 hereof can also be connected end-to-end to form an elongated barrier, as well as being used to form the more conventional T-shapes of FIG. 2A. The end-to-end connection, moreover, need not be confined to a single plane, but contemplates that adjacent panels be oriented at selected angles to each other so as to form a partially completed polygon, i.e. a polygon shape with an entrance opening into same. For this end-to-end connection, it is necessary only that each panel 30 have the hook-extending construction 38 along the strip length overlying one vertical edge and a loop construction 36 in the strip length overlying the other vertical edge. As a consequence, panels 30 so constructed are readily attachable to each other by contact of the edges thereon having the interconnecting Velcro-type fasteners 36 and 38.

A latitude of modification, change and substitution is intended in the foregoing disclosures and in some instances some features of the invention will be employed without a corresponding use of other features. Accordingly, it is appropriate that the appended claims be construed broadly and in a manner consistent with the spirit and scope of the invention herein.

What is claimed is:

1. An improved partition panel for combination with similarly constructed partition panels in subdividing the area of a room, said improved partition panel comprising an internal plastic body having plural openings therein for reducing the weight thereof, a rectangular frame having a rectangular opening therein sized to receive therein said plastic body to form a composite body structure, a pair of flat sheets applied as facing on opposite sides of said composite body structure to complete the construction of said partition panel, a pair of fabric covers, each of a looped fibrous construction, adhesively secured in covering relation on opposite sides of said partition panel, and a fabric strip, of an extending hook-like fibrous construction adapted to engage with said looped fibrous construction of said fabric covers, adhesively secured about the periphery of said partition panel for achieving said engagement of said panel incident to the contact of said fabric strip thereof to said fabric cover of a cooperating panel, said fabric strip being of a lengthwise size to extend along both vertically oriented edges and at least along one horizontally oriented edge of said partition panel, whereby during disengagement of said two partition panels at the juncture of a vertically oriented edge of one from its contact with a fabric cover of the other the length portion of said fabric strip being disengaged is prevented from inadvertent removal from about said partition panel by said wrapped positioning of said remaining length portion thereof relative to said panel edges.

2. An improved fabric-covered partition panel as claimed in claim 1, wherein said rectangular frame has a centrally located groove about its peripheral edge and the peripheral edges of said fabric covers are adhesively secured in folded over relation about said rectangular frame in opposite directions toward said groove, and there is further provided a T-shaped mounting strip adapted to have said fabric strip wrapped about one leg thereof and to have said other leg thereof projected into said groove of said rectangular frame, whereby said folded over edges of said fabric covers are advantageously both covered and additionally secured in place by said T-shaped mounting strip, and an unobstructed face of said fabric strip supported on said mounting strip is presented for attachment to a fabric cover of a cooperating partition panel.

3. An improved fabric-covered partition panel as claimed in claim 2, wherein only said length portion of said fabric strip coextensive with each vertically oriented edge of said partition panel is of said extending hook-like fibrous construction.

4. An improved fabric-covered partition panel as claimed in claim 2, wherein the length portion of said fabric strip coextensive with one vertically oriented edge is of said extending hook-like fibrous construction and that of said other vertically oriented edge is of said looped fibrous construction.

* * * * *